US010036342B2

(12) United States Patent
Takeshita et al.

(10) Patent No.: US 10,036,342 B2
(45) Date of Patent: Jul. 31, 2018

(54) VEHICLE AND MANUFACTURING METHOD OF VEHICLE

(71) Applicant: Kawasaki Jukogyo Kabushiki Kaisha, Kobe-shi, Hyogo (JP)

(72) Inventors: Tomoyuki Takeshita, Akashi (JP); Tetsuya Mori, Kobe (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 29 days.

(21) Appl. No.: 15/274,878

(22) Filed: Sep. 23, 2016

(65) Prior Publication Data

US 2017/0089289 A1 Mar. 30, 2017

(30) Foreign Application Priority Data

Sep. 24, 2015 (JP) ..... 2015-186948

(51) Int. Cl.
*F02D 41/24* (2006.01)
*F02D 41/04* (2006.01)
(Continued)

(52) U.S. Cl.
CPC ..... *F02D 41/2464* (2013.01); *F02D 9/02* (2013.01); *F02D 9/109* (2013.01); *F02D 41/042* (2013.01);
(Continued)

(58) Field of Classification Search
CPC .... F02D 9/02; F02D 9/109; F02D 2009/0213; F02D 2009/0272; F02D 41/24;
(Continued)

(56) References Cited

U.S. PATENT DOCUMENTS 5,575,255 A 11/1996 Abe et al.
7,287,511 B2 * 10/2007 Matsuda ..... F02D 9/105 123/399
7,856,305 B2 * 12/2010 Eiraku ..... F02D 41/0002 123/396
7,980,219 B2 * 7/2011 Sano ..... F02B 31/06 123/184.53
(Continued)

FOREIGN PATENT DOCUMENTS

DE 102006035372 A1 5/2007
EP 2735718 A1 5/2014
JP 2007077888 A 3/2007

OTHER PUBLICATIONS

European Patent Office, Extended European Search Report Issued in Application No. 16190442.0, dated Feb. 16, 2017, Germany, 8 pages.

*Primary Examiner* — John Kwon
*Assistant Examiner* — Johnny H Hoang
(74) *Attorney, Agent, or Firm* — Alleman Hall Creasman & Tuttle LLP

(57) ABSTRACT

A vehicle comprises an engine, a throttle body including a passage section and a throttle valve, and a throttle valve controller which controls opening or closing of the throttle valve, wherein the throttle valve controller includes: a memory section which contains therein a medium output control command such that the medium output control command continues to be stored in the memory section in a state in which electric power supply to the throttle valve controller is ceased, the medium output control command indicating an opening degree of the throttle valve, corresponding to a preset medium output range, and wherein the throttle valve controller controls opening or closing of the throttle valve, in accordance with the medium output control command read from the memory section, when an engine output meets a medium output condition in which the engine output is controlled to fall into the medium output range.

5 Claims, 5 Drawing Sheets

(51) Int. Cl.

| | |
|---|---|
| ***F02D 9/02*** | (2006.01) |
| ***F02D 9/10*** | (2006.01) |
| *F02B 61/02* | (2006.01) |
| *F02D 41/00* | (2006.01) |
| *F02D 11/10* | (2006.01) |

(52) U.S. Cl.
CPC ..... *F02D 41/2441* (2013.01); *F02D 41/2451* (2013.01); *F02B 61/02* (2013.01); *F02D 41/0002* (2013.01); *F02D 2009/0213* (2013.01); *F02D 2009/0272* (2013.01); *F02D 2011/102* (2013.01); *F02D 2250/16* (2013.01); *F02D 2250/26* (2013.01)

(58) Field of Classification Search
CPC ..... F02D 41/2441; F02D 41/2451; F02D 41/2464; F02D 41/042; F02D 41/0002; Y02T 10/42; Y02T 10/70; Y02T 10/7077
USPC ..... 701/101–103, 106, 114, 115; 123/336, 123/337, 339.1, 350, 367, 370, 371, 403, 123/674, 683
See application file for complete search history.

(56) References Cited

U.S. PATENT DOCUMENTS

| | | | | |
|---|---|---|---|---|
| 9,273,620 | B2 * | 3/2016 | Klaser-Jenewein | F02D 29/06 |
| 2004/0186659 | A1 * | 9/2004 | Hashimoto | F02D 11/107 701/114 |
| 2006/0042593 | A1 * | 3/2006 | Nakamoto | F02D 9/109 123/399 |
| 2006/0046896 | A1 * | 3/2006 | Nakajima | B60W 10/06 477/107 |
| 2006/0107923 | A1 | 5/2006 | Kusatsugu et al. | |
| 2006/0196473 | A1 * | 9/2006 | Hasegawa | F02D 9/02 123/406.47 |
| 2008/0115761 | A1 | 5/2008 | Deguchi et al. | |
| 2009/0138174 | A1 * | 5/2009 | Nishida | F02B 17/00 701/103 |
| 2009/0265076 | A1 | 10/2009 | Hirose | |
| 2009/0292452 | A1 * | 11/2009 | Nishimura | F02D 11/10 701/106 |
| 2012/0166068 | A1 * | 6/2012 | Kuratani | F01N 3/30 701/104 |
| 2015/0088401 | A1 * | 3/2015 | Hotani | F02D 41/1497 701/103 |

* cited by examiner

VEHICLE AND MANUFACTURING METHOD OF VEHICLE

CROSS-REFERENCE TO THE RELATED APPLICATION

This application claims priority to and the benefit of Japanese Patent Application No. 2015-186948 filed on Sep. 24, 2015, the entire disclosure of which is incorporated herein by reference.

BACKGROUND OF THE INVENTION

Field of the Invention

The present invention relates to a vehicle, and a manufacturing method of the vehicle.

Description of the Related Art

An exemplary vehicle such as a motorcycle is provided with a throttle body connecting an engine and an air cleaner box to each other. The throttle body includes an air passage through which air to be supplied to an engine flows, and a throttle valve for controlling an air amount by opening or closing the air passage (see e.g., Japanese Laid-Open Patent Application Publication No. 2007-77888).

In some cases, in the vehicle, an engine output is limited to an upper limit value. In other cases, the engine output is controlled to fall into a predetermined range with a high accuracy. The engine output is changed with an increase/decrease in the amount of the air to be supplied to the engine. Therefore, the engine output is sometimes controlled in such a manner that the opening degree of a throttle valve for controlling the air amount is controlled to obtain a medium (intermediate) output.

Conventionally, in a case where the medium output is obtained, an opening degree (medium opening degree) corresponding to the medium output is set based on a ratio (percentage) with respect to a fully open position of the throttle valve or a fully closed position of the throttle valve. In this configuration, the medium output deviates from a target value among products of the throttle body, depending on the dimension accuracy of the throttle valve, an assembling error, and the like. For this reason, it is difficult to accurately control the engine output so that it reaches the medium output.

In view of the above-described circumstances, an object of the present invention is to accurately control an engine output so that it falls into a preset range.

SUMMARY OF THE INVENTION

According to an aspect of the present invention, a vehicle comprises: an engine; a throttle body including a passage section formed with an air-intake passage through which air to be supplied to the engine flows, and a throttle valve provided in the air-intake passage; and a throttle valve controller which controls opening or closing of the throttle valve, wherein the throttle valve controller includes: a memory section which contains therein a medium output control command in such a manner that the medium output control command continues to be stored in the memory section in a state in which electric power supply to the throttle valve controller is ceased, the medium output control command indicating an opening degree of the throttle valve, corresponding to a preset medium output range included in a range between a minimum output and a maximum output of an engine output, and wherein the throttle valve controller controls opening or closing of the throttle valve, in accordance with the medium output control command read from the memory section, when the engine output meets a medium output condition in which the engine output is controlled to fall into the medium output range.

In accordance with this configuration, the medium output control command which allows the engine output to surely fall into the medium output range, by measurement performed in advance, requirements specification, etc., is stored in the memory section of the throttle valve controller, and the throttle valve controller controls opening or closing of the throttle valve in accordance with the medium output control command read from the memory section. This makes it possible to accurately control the engine output so that it falls into the medium output range when the engine output meets the medium output condition, compared to a configuration in which the medium opening degree of the throttle valve corresponding to the medium output range is set based on a ratio with respect to the fully closed position or the fully open position of the throttle valve.

The throttle valve controller may further include: a learning section which performs a learning operation for learning a fully closed position or a fully open position of the throttle valve at which a motion of the throttle valve is physically inhibited, wherein the throttle valve controller may control opening or closing of the throttle valve, in accordance with a control command based on a learning value obtained by the learning section, when the engine output does not meet the medium output condition.

In accordance with this configuration, the throttle valve controller includes both of the control command of the throttle valve based on the learning value and the control command of the throttle valve based on the medium output control command. In this configuration, it is not necessary to manufacture a throttle body to prevent occurrence of non-uniformity of the engine output in a case where the engine output does not meet the medium output condition. In addition, the engine output can be controlled accurately so that it falls into the medium output range when the engine output meets the medium output condition. Therefore, it becomes possible to prevent occurrence of non-uniformity of the medium opening degree of the throttle valve corresponding to the medium output range, among products of the throttle body, without increasing manufacturing cost.

The learning section may learn the fully closed position and the fully open position of the throttle valve, and the throttle valve controller may control opening or closing of the throttle valve in accordance with the control command based on the learning value obtained by the learning section, when the engine output does not meet the medium output condition.

In accordance with this configuration, the throttle valve controller learns as the learning values, both of the fully closed position of the throttle valve which may be non-uniform and the fully open position of the throttle valve which may be non-uniform. Thus, the opening degree of the throttle valve can be set more accurately, compared to a configuration in which the learning section learns either the fully closed position or the fully open position in a case where the throttle valve controller controls opening or closing of the throttle valve, when the engine output does not meet the medium output condition.

The vehicle may further comprise: a termination request detector which detects a termination request command regarding driving of the engine, and the learning section may perform the learning operation, when the termination request detector has detected the termination request command.

In accordance with this configuration, the throttle valve controller learns the fully closed position or the fully open position of the throttle valve, when the termination request detector has detected the termination request command regarding the driving of the engine. In this configuration, when the engine is started, the learning value stored when the termination request detector previously detected the termination request command is read from the memory section, and therefore the rider need not wait for the completion of the learning operation, compared to a configuration in which the throttle valve controller learns the fully closed position or the fully open position of the throttle valve after a start request command regarding driving of the engine is detected, namely, after the engine is started.

The learning section may perform the learning operation when driving control for the engine is stopped.

In accordance with this configuration, since the learning section performs the learning operation when the driving control for the engine is stopped, it becomes possible to prevent a change in an engine speed, while the learning section is performing the learning operation. This can prevent a rider of the vehicle from feeling awkward.

The memory section may store therein the learning value obtained by the learning section before the electric power supply to the throttle valve controller is ceased, and the throttle valve controller may read the learning value from the memory section after the electric power supply to the throttle valve controller is started, and control opening or closing of the throttle valve based on the learning value.

In accordance with this configuration, since the memory section stores therein the learning value before the electric power supply to the throttle valve controller is ceased, and the throttle valve controller reads the learning value from the memory section after the electric power supply to the throttle valve controller is started, the rider need not wait for the completion of the learning operation, compared to a configuration in which the memory section stores therein the learning value after the electric power supply to the throttle valve controller is started.

According to another aspect of the present invention, a method of manufacturing a vehicle comprises measuring a medium output opening degree of a test throttle valve, corresponding to a preset medium output range included in a range between a minimum output and a maximum output of a test engine output, by use of an engine bench test apparatus which obtains the test engine output; measuring a medium output intake air amount in a case where the test throttle valve is opened at the medium output opening degree; assembling a throttle body to be mounted in the vehicle in such manner that the medium output opening degree of the throttle valve to be mounted in the vehicle falls into a preset tolerance range, the medium output intake air amount being obtained at the medium output opening degree; and storing a medium output control command in a throttle valve controller which controls opening or closing of the throttle valve to be mounted in the vehicle, the medium output control command indicating the medium output opening degree of the throttle valve to be mounted in the vehicle, corresponding to the medium output intake air amount.

In this method, in a case where the vehicle in which the engine output is controlled to fall into the preset medium output range is manufactured, the opening degree of the throttle valve corresponding to the medium output range is measured, then the intake air amount of the air to be supplied to the engine when the throttle valve is opened at the measured opening degree is measured, and then the throttle body is assembled in such a manner that the opening degree of the throttle valve corresponding to the intake air amount falls into the tolerance range. Thus, in a case where the engine output is controlled to fall into the medium output range after the vehicle is manufactured, the throttle valve can be opened at the opening degree measured in advance, in accordance with the medium output control command provided by the throttle valve controller. As a result, the engine output can be controlled with a high accuracy.

According to a further aspect of the present invention, a vehicle comprises an engine; a throttle body including a passage section formed with an air-intake passage through which air to be supplied to the engine flows, and a throttle valve provided in the air-intake passage; a throttle valve controller which controls opening or closing of the throttle valve; and a termination request detector which detects a termination request command regarding driving of the engine, wherein the throttle valve controller includes: a learning section which learns a fully closed position or a fully open position of the throttle valve at which a motion of the throttle valve is physically inhibited, when the termination request detector has detected the termination request command, and a memory section which contains therein a medium output control command in such a manner that the medium output control command continues to be stored in the memory section in a state in which electric power supply to the throttle valve controller is ceased, the medium output control command indicating an opening degree of the throttle valve, corresponding to a preset medium output range included in a range between a minimum output and a maximum output of an engine output, wherein the memory section stores therein the learning value obtained by the learning section before the electric power supply to the throttle valve controller is ceased, and wherein the throttle valve controller reads the learning value from the memory section after the electric power supply to the throttle valve controller is started, and controls opening or closing of the throttle valve based on the learning value.

In accordance with this configuration, since the throttle valve controller includes the learning section which learns the fully closed position or the fully open position of the throttle valve, and the memory section which contains therein the medium output control command indicating the opening degree of the throttle valve, corresponding to the preset medium output range, the control performed for the throttle valve based on the learning value obtained by the learning section or the control performed for the throttle valve in accordance with the medium output control command can be chosen. In addition, the engine output can be controlled to fall into a preset range with a high accuracy in a case where the engine output is controlled to fall into the medium output range.

The above and further objects, features and advantages of the present invention will more fully be apparent from the following detailed description of preferred embodiment with accompanying drawings.

DETAILED DESCRIPTION OF THE EMBODIMENTS

Hereinafter, the embodiment of the present invention will be described with reference to the drawings. Throughout the drawings, the same or corresponding components are designated by the same reference symbols, and will not be described repeatedly. The stated directions are from the perspective of a rider straddling a motorcycle. A vehicle width direction of the vehicle body of the motorcycle corresponds with a rightward and leftward direction.

Figure 1:
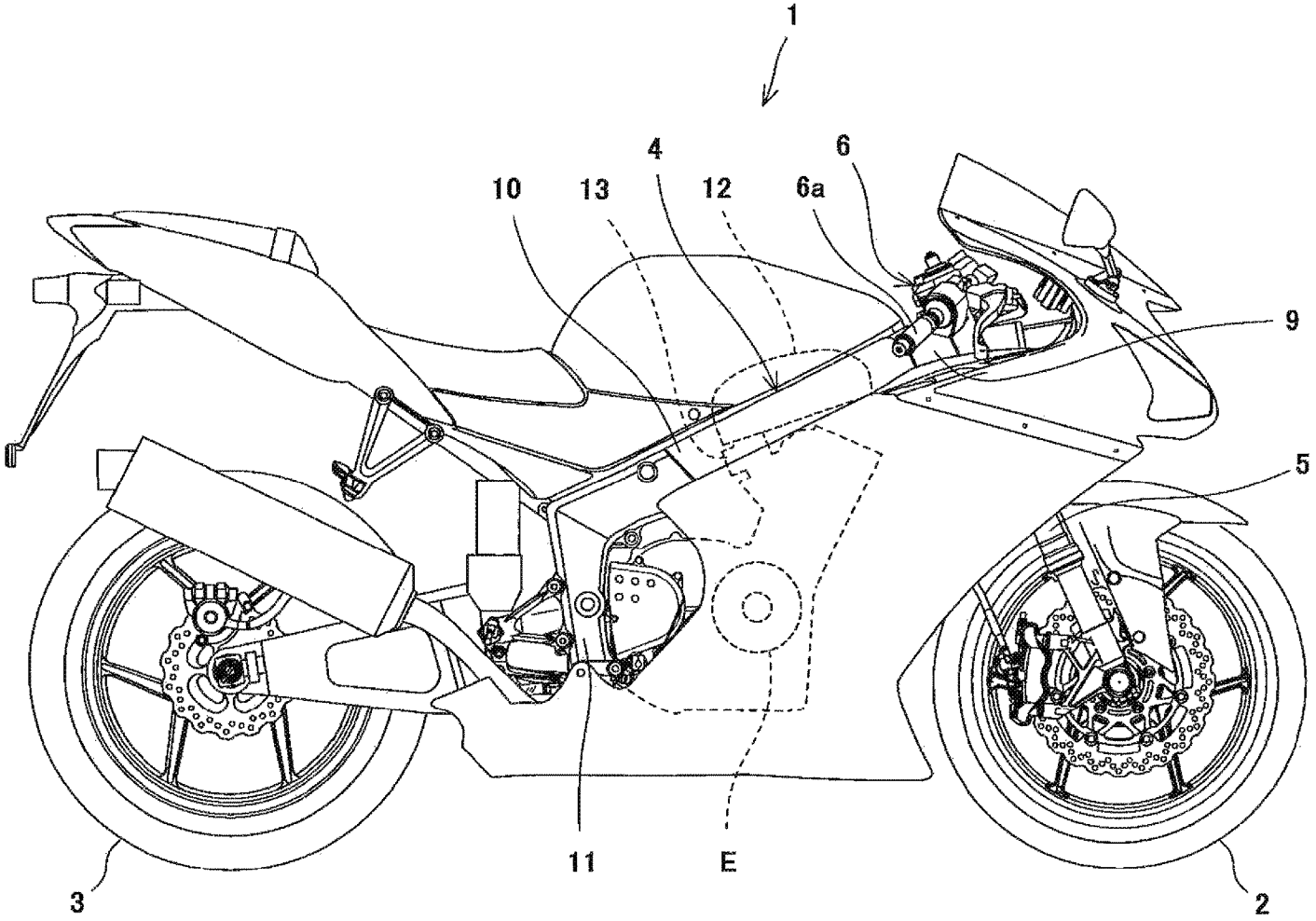
FIG. 1 is a right side view of a motorcycle which is an example of a vehicle according to the embodiment of the present invention.

FIG. 1 is a right side view of a motorcycle 1 according to the embodiment. As shown in FIG. 1, the motorcycle 1 includes a front wheel 2, a rear wheel 3, and a vehicle body frame 4 placed between the front wheel 2 and the rear wheel 3. The front wheel 2 is rotatably mounted to the lower end portion of a front fork 5 extending substantially vertically. A handle 6 extending in the rightward and leftward direction is rotatably attached to the upper end portion of the front fork 5 via a steering shaft (not shown). A throttle grip 6*a* which can be gripped by the rider's right hand is attached to the right end of the handle 6. The rear wheel 3 is rotatably mounted to the vehicle body frame 4 via a swing arm 8.

The vehicle body frame 4 includes a head pipe 9, a main frame 10 extending rearward from the head pipe 9, and a pivot frame 11 extending downward from the rear end of the main frame 10. An engine E is mounted to and supported on the main frame 10 and the pivot frame 11. An air cleaner box 12 is connected to the engine E via a throttle body 13. An air duct (not shown) is connected to the front end portion of the air cleaner box 12 to take the air from an outside region into the air cleaner box 12. The air flows into the air cleaner box 12 through the air duct and is filtered by an air cleaner element of the air cleaner box 12. The resulting clean air is supplied to the engine E. The throttle body 13 controls the amount of the air to be supplied to the engine E.

Figure 2B:
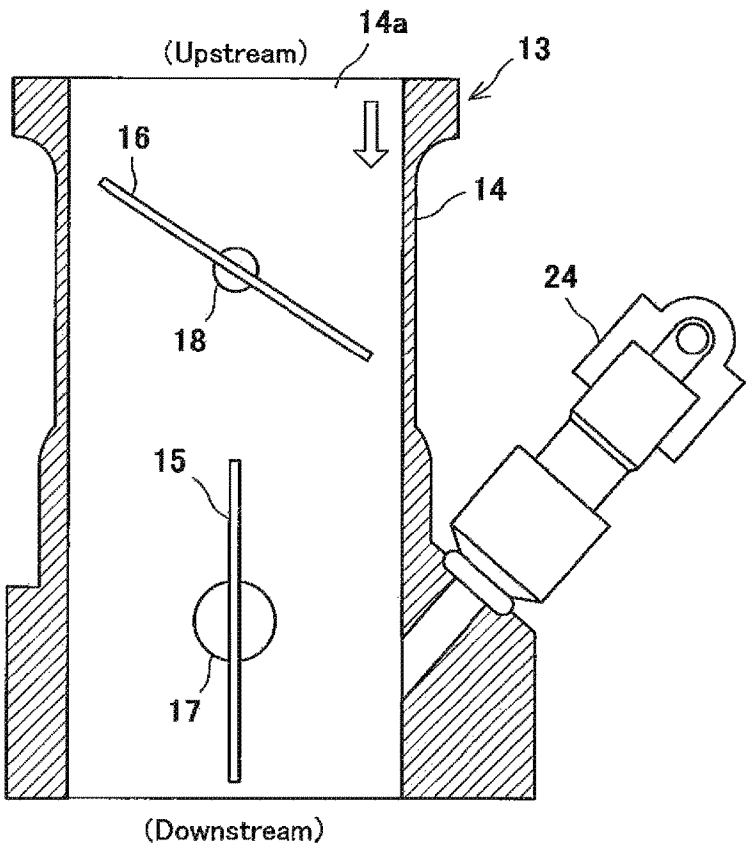
FIG. 2B is a schematic cross-sectional view of the throttle body of FIG. 1, in a case where an engine output is controlled to become a medium output.
Figure 2A:
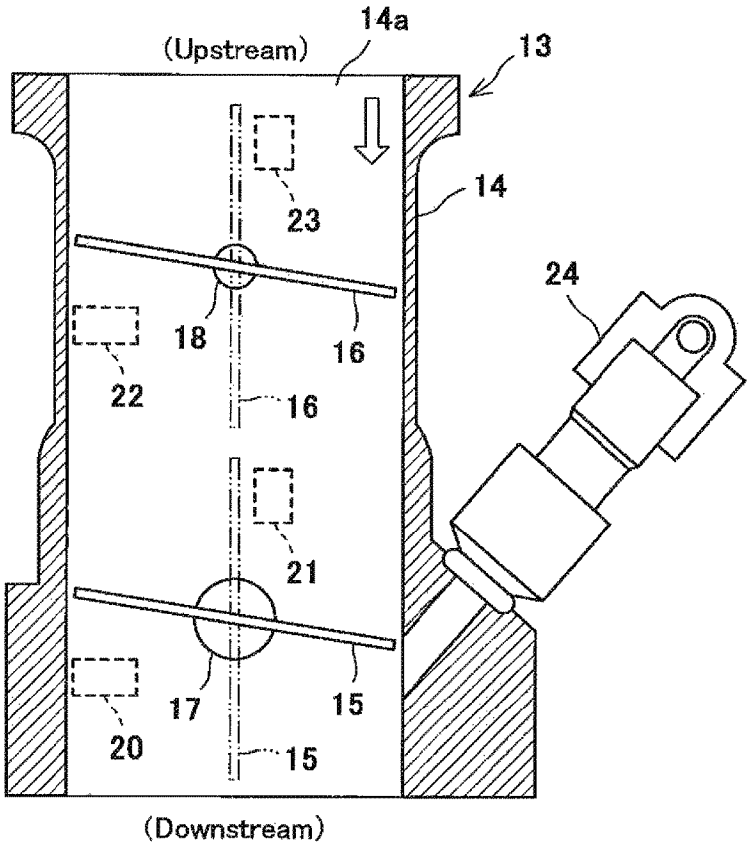
FIG. 2A is a schematic cross-sectional view of a throttle body of FIG. 1.

FIG. 2A is a schematic cross-sectional view of the throttle body 13 of FIG. 1.

Referring now to FIG. 2A, the throttle body 13 includes a passage section 14 of a substantially cylindrical shape. Inside the passage section 14, an air-intake passage 14*a* is formed. The air is supplied to the engine E through the air-intake passage 14*a*. The air-intake passage 14*a* is in communication with the combustion chamber of the engine E. The air-intake passage 14*a* is provided with a main throttle valve 15 and a sub-throttle valve 16.

The main throttle valve 15 and the sub-throttle valve 16 are members of a substantially disc shape, respectively. The outer diameter of the main throttle valve 15 and the outer diameter of the sub-throttle valve 16 are set to be smaller than the inner diameter of the passage section 14 of the throttle body 13, to circumvent interference of the main throttle valve 15 and the sub-throttle valve 16 with the inner wall surface of the passage section 14. The sub-throttle valve 16 is disposed adjacently to the main throttle valve 15 in an air-intake direction (air flow direction) as indicated by an arrow of FIG. 2A. In the present embodiment, the sub-throttle valve 16 is located upstream of the main throttle valve 15 in the air-intake direction. Alternatively, the sub-throttle valve 16 may be disposed downstream of the main throttle valve 15 in the air-intake direction.

In the air-intake passage 14*a*, the main throttle valve 15 is mounted to a main throttle shaft 17, while the sub-throttle valve 16 is mounted to a sub-throttle shaft 18. The main throttle shaft 17 is a rotary shaft rotatably provided to open or close the main throttle valve 15. The sub-throttle shaft 18 is a rotary shaft rotatably provided to open or close the sub-throttle valve 16.

The first axial end portion of the main throttle shaft 17 is coupled to a throttle pulley provided outside the passage section 14. The throttle pulley is connected to the throttle grip 6*a* via a throttle wire (not shown). When the rider operates (rotates) the throttle grip 6*a*, the throttle pulley is rotated in response to the amount of the operation (rotation or displacement) of the throttle grip 6*a*, and thus, the main throttle valve 15 is opened or closed. A sub-throttle motor 19 (see FIG. 3) is mounted to the throttle body 13 to rotate the sub-throttle shaft 18. The sub-throttle motor 19 drives the sub-throttle shaft 18 in response to a control command provided by an electric control unit (ECU) 30 to control or close the sub-throttle valve 16.

For example, in a case where the rider operates the throttle grip 6*a* and thereby the main throttle valve 15 is rapidly opened or closed, the opening degree of the sub-throttle valve 16 (hereinafter, this will be also referred to as "sub-throttle valve opening degree") is controlled by the ECU 30 to prevent a situation in which the engine speed is rapidly changed and thereby the rider feels awkward.

The sub-throttle valve 16 is connected to the main throttle valve 15 via a link mechanism (not shown). During idling (first idling) at the start of the engine E, the rider does not operate the throttle grip 6*a*, and the main throttle valve 15 is not opened or closed. To secure a desired intake air amount at the start of the engine E, and stabilize combustion in the engine E, the sub-throttle valve 16 is opened or closed in response to a control command provided by the ECU30, and the opening/closing motion of the sub-throttle valve 16 is transmitted to the main throttle valve 15 via the link mechanism. Thus, the main throttle valve 15 is also opened or closed.

The opening/closing motion of each of the main throttle valve 15 and the sub-throttle valve 16 is physically inhibited at a fully closed position and at a fully open position. In the example of FIG. 2A, solid lines indicate a state in which the main throttle valve 15 and the sub-throttle valve 16 are at the fully closed positions, respectively, while two-dotted lines indicate a state in which the main throttle valve 15 and the sub-throttle valve 16 are at the fully open positions, respectively. In the present embodiment, stoppers provided on the outer wall surface of the passage section 14 serve to inhibit the opening/closing motion of the main throttle valve 15 and the opening/closing motion of the sub-throttle valve 16, respectively.

Specifically, a fully closing stopper 20 and a fully open stopper 21 are provided on the outer wall surface of the passage section 14 in such a manner that the stoppers 20, 21 are on a concentric circle with a center axis of the main throttle shaft 17. A contact portion (not shown) provided at the throttle pulley for driving the main throttle shaft 17 contacts the fully closing stopper 20 or the fully open stopper 21, and thus the main throttle valve 15 is stopped at the fully closed position or the fully open position. In addition, a fully closing stopper 22 and a fully open stopper 23 are provided on the outer wall surface of the passage section 14 in such a manner that the stoppers 22, 23 are on a concentric circle with a center axis of the sub-throttle shaft 18. A contact portion (not shown) provided at the sub-throttle motor 19 for driving the sub-throttle shaft 18 contacts the fully closing stopper 22 or the fully open stopper 23, and thus the sub-throttle valve 16 is stopped at the fully closed position or the fully open position.

Hereinafter, the opening degree of each of the throttle valves 15, 16 is represented by a ratio in a case where the opening degree of each of the throttle valves 15, 16 at the fully closed position is 0% and the opening degree of each of the throttle valves 15, 16 at the fully open position is 100%.

An injector 24 is fastened to the passage section 14 of the throttle body 13 to inject fuel into the air-intake passage 14*a*. The fuel injection amount of the injector 24 is controlled according to the amount of the air to be supplied to the combustion chamber of the engine E. The output of the engine E (hereinafter this will be referred to as an engine output) is controlled by changing the amount of the air to be supplied to the engine E (intake air amount), the fuel injection amount and ignition timing.

In the present embodiment, the motorcycle 1 is a vehicle in which the engine output is limited to a predetermined upper limit value (in this example, 35 kW) depending on the classification of a license acquired by the rider. The upper limit value of the engine output is not limited to 35 kW, and may be other values. 35 kW which is the upper limit value of the engine output corresponds to a medium (intermediate) output included in a range between a minimum output and a maximum output of the engine output. When the engine output meets a predetermined condition while the motorcycle 1 is traveling, the engine output is controlled to become the medium output. A condition in which the engine output is controlled to become the medium output will be referred to as a medium output condition. In the present embodiment, the medium output condition is an output limiting condition in which the engine output is limited to 35 kW.

An output limiting condition determiner section 32 of the ECU 30 which will be described later determines whether or not the engine output meets the output limiting condition. For example, in a case where the main throttle valve opening degree is the fully open position as shown in FIG. 2B, the engine output is controlled to become the medium output irrespective of the value of the engine speed. Hereinafter, the sub-throttle valve opening degree in a case where the engine output is controlled to become the medium output will be referred to as a medium output opening degree.

In the motorcycle 1, the engine output is limited to the upper limit value by adjusting the intake air amount of the air to be supplied to the engine E. Specifically, when the output limiting condition determiner section 32 determines that the engine output meets the output limiting condition while the motorcycle 1 is traveling, the ECU 30 performs the control for opening or closing the sub-throttle valve 16 of the throttle body 13 to adjust the intake air amount, thereby limiting the engine output to 35 kW. Now, a configuration for limiting the engine output, namely, a configuration for performing the control for opening or closing the sub-throttle valve 16 will be described.

Figure 3:
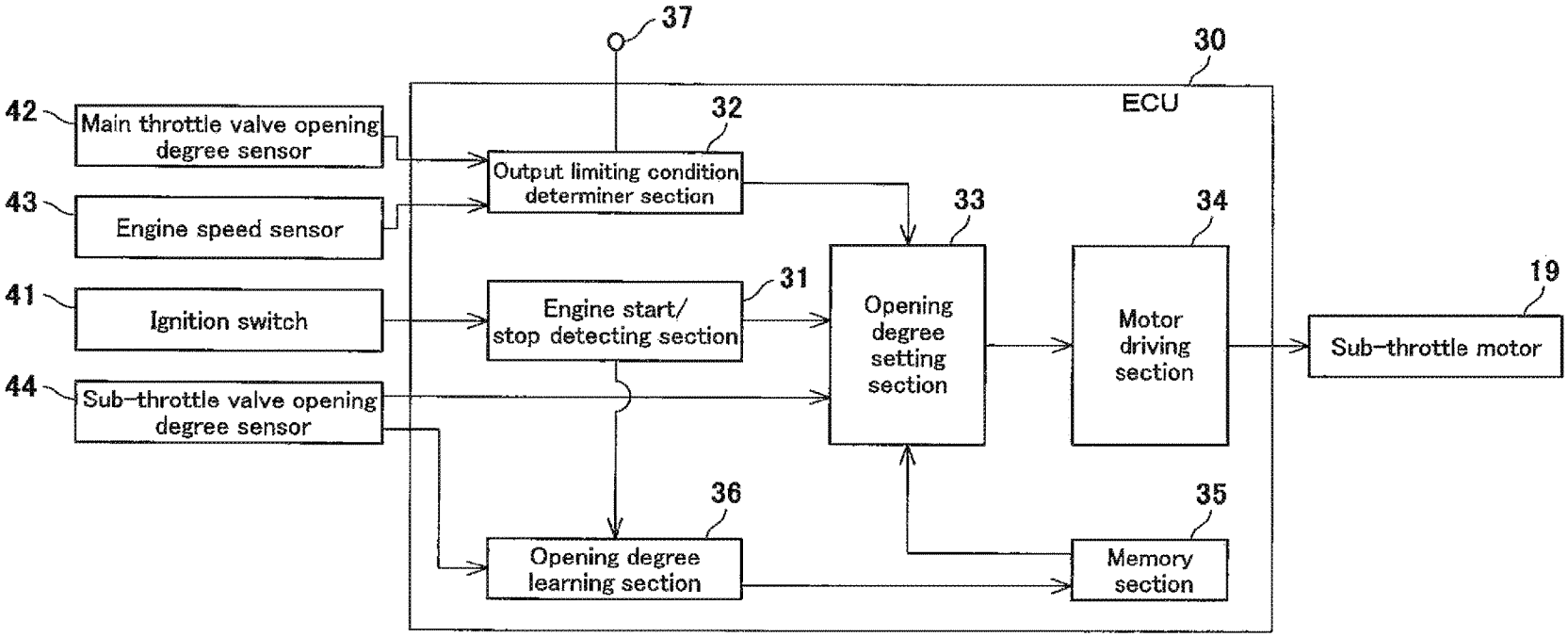
FIG. 3 is a block diagram showing a configuration for performing a control for opening or closing a sub-throttle valve of FIG. 2.

FIG. 3 is a block diagram showing the configuration for performing the control for opening or closing the sub-throttle valve 16 of FIG. 2. As shown in FIG. 3, the motorcycle 1 includes the ECU 30 which provides the drive command to the sub-throttle motor 19. The ECU 30 executes preset control programs, and drives the sub-throttle motor 19, based on output signals of various sensors mounted to the motorcycle 1. In this way, the ECU 30 performs the control for opening or closing the sub-throttle valve 16. In brief, the ECU 30 has a function as a throttle valve controller which performs the control for opening or closing the sub-throttle valve 16.

The ECU 30 includes an engine start/stop detecting section 31, the output limiting condition determiner section 32, an opening degree setting section 33, a motor driving section 34, a memory section 35, and an opening degree learning section 36. An ignition switch 41 is connected to the engine start/stop detecting section 31. When the ignition switch 41 has been turned on, the engine start/stop detecting section 31 detects that a start request command regarding driving of the engine E has been output. In other words, the engine start/stop detecting section 31 detects that the engine E has been started. On the other hand, when the ignition switch 41 has been turned off, the engine start/stop detecting section 31 detects that a termination request command regarding the driving of the engine E has been output. In other words, the engine start/stop detecting section 31 detects that the engine E has been stopped. Thus, the engine start/stop detecting section 31 has a function as a start request detector for detecting the start request command regarding driving of the engine E and a function as a termination request detector for detecting the termination request command regarding the driving of the engine E.

A main throttle valve opening degree sensor 42 and an engine speed sensor 43 are connected to the output limiting condition determiner section 32. The main throttle valve opening degree sensor 42 detects as a voltage value the opening degree (hereinafter this will be referred to as a main throttle valve opening degree) of the main throttle valve 15, and outputs the voltage value to the output limiting condition determiner section 32. The engine speed sensor 43 detects the engine speed and outputs the detected engine speed to the output limiting condition determiner section 32.

The output limiting condition determiner section 32 contains therein a limiting determination program used to determine whether or not to limit the engine speed to 35 kW based on the signal output from the main throttle valve opening degree sensor 42 and the signal output from the engine speed sensor 43. When the main throttle valve opening degree is equal to or larger than a predetermined threshold, and the engine speed is equal to or higher than a predetermined threshold, in a state in which the limiting determination program of the output limiting condition determiner section 32 is enabled (effective), the output limiting condition determiner section 32 determines that the engine output meets the output limiting condition. For example, when the main throttle valve opening degree is equal to or larger than 50% and the engine speed is equal to or higher than 4000 rpm, in a state in which the limiting determination program of the output limiting condition determiner section 32 is enabled, the output limiting condition determiner section 32 determines that the engine output meets the output limiting condition. As described above, when the main throttle valve opening degree is 100% (the fully open position) (see FIG. 2B), the output limiting condition determiner section 32 determines that the engine output meets the output limiting condition, irrespective of the value of the engine speed.

On the other hand, when the main throttle valve opening degree is less than the predetermined threshold, and the engine speed is lower than the predetermined threshold, even in the state in which the limiting determination program of the output limiting condition determiner section 32 is enabled, the output limiting condition determiner section 32 determines that the engine output does not meet the output limiting condition. In a state in which the limiting determination program of the output limiting condition determiner section 32 is disenabled, the output limiting condition determiner section 32 determines that the engine output does not meet the output limiting condition, irrespective of the value of the main throttle valve opening degree and the value of the engine speed.

The output limiting condition determiner section 32 is connectable to an external input device via a connection terminal 37 provided at the ECU 30. For example, the connection terminal 37 is communicable with the external input device via a cable. Alternatively, the connection terminal 37 may be wirelessly communicable with the external input device. Since the output limiting condition determiner section 32 is connectable to the external input device via the connection terminal 37, the limiting determination program which is enabled (effective), in the output limiting condition determiner section 32, may be externally disenabled by use of the external input device. It should be noted that the limiting determination program may be rewritten into a program which is not used to limit the engine output, via the connection terminal 37.

The opening degree setting section 33 sets the target opening degree of the sub-throttle valve 16 based on a result of the determination performed by the output limiting condition determiner section 32, and outputs a signal indicating the target opening degree to the motor driving section 34. The motor driving section 34 is a driving circuit which drives the sub-throttle motor 19, based on the signal output from the opening degree setting section 33. A sub-throttle valve opening degree sensor 44 is connected to the opening degree setting section 33. The sub-throttle valve opening degree sensor 44 detects the sub-throttle valve opening degree as a voltage value and outputs the voltage value to the opening degree setting section 33. Based on the voltage value, the opening degree setting section 33 performs a feedback control so that the detected sub-throttle valve opening degree becomes close to the target opening degree. Further, the memory section 35 is connected to the opening degree setting section 33.

The memory section 35 is an electrically erasable programmable read-only memory (EEPROM) (non-volatile memory) in which data continues to be stored even in a state in which electric power supply to the ECU 30 is ceased. The memory section 35 contains therein a medium (intermediate) output control command indicating the sub-throttle valve opening degree (medium output opening degree) corresponding to the medium output of the engine output. More specifically, the memory section 35 contains therein the sub-throttle valve opening degree corresponding to the intake air amount of the air to be supplied to the engine E when the engine output meets the output limiting condition (see FIG. 4).

In addition, the memory section 35 contains therein as a map the target opening degrees of the sub-throttle valve 16 in a case where the engine output does not meet the output limiting condition. Specifically, the target opening degrees of the sub-throttle valve 16, corresponding to the engine speeds, respectively, are stored in the memory section 35 in such a manner that the target opening degrees of the sub-throttle valve 16 correspond to various main throttle valve opening degrees, respectively. Each of the target opening degrees of the sub-throttle valve 16 is stored in the memory section 35 as a ratio in a case where the fully closed position of the sub-throttle valve 16 is 0% and the fully open position of the sub-throttle valve 16 is 100%. Specifically, when the engine output does not meet the output limiting condition, the sub-throttle valve opening degree is not set to the medium output opening degree, and is set to the target opening degree corresponding to the main throttle valve opening degree and the engine speed, which is read from the map stored in the memory section 35. Therefore, when the engine output does not meet the output limiting condition, the engine output is not limited to 35 kW.

The memory section 35 is electrically connected to the opening degree learning section 36. In the present embodiment, the opening degree learning section 36 is a random access memory (RAM) which is capable of temporarily storing data only when the electric power supply to the ECU 30 is maintained. The opening degree learning section 36 learns the fully closed position and the fully open position (see FIG. 4) of the sub-throttle valve 16 which are detected by the sub-throttle valve opening degree sensor 44. The learning values (the fully closed position and the fully open position of the sub-throttle valve 16) obtained by the opening degree learning section 36 are stored in the memory section 35 which is the EEPROM. This allows the learning values to be stored in the memory section 35 even in a state in which the electric power supply to the ECU 30 is ceased.

Figure 4:
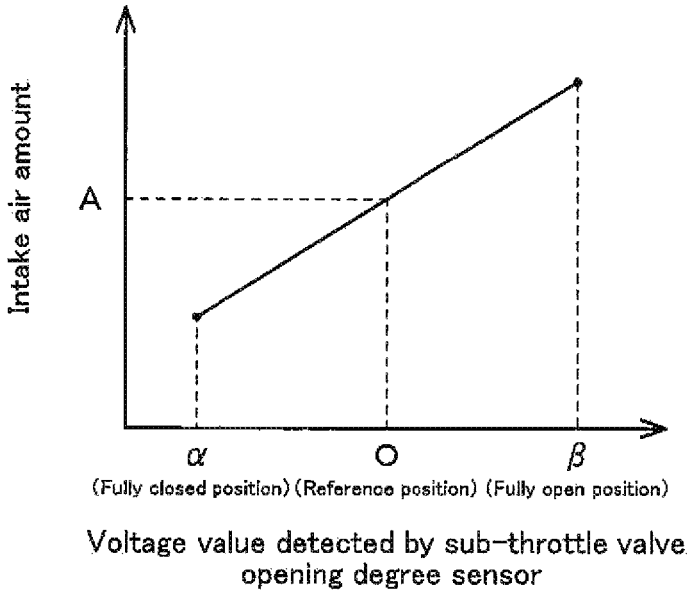
FIG. 4 is a graph showing a relation between a voltage value and an intake air amount, which are associated with the opening degree of the sub-throttle valve of FIG. 2.

FIG. 4 is a graph showing a relation between the voltage value and the intake air amount, which are associated with the opening degree of the sub-throttle valve 16 of FIG. 2. Referring to FIG. 4, a voltage value O indicating the medium output opening degree of the sub-throttle valve 16, corresponding to an intake air amount A in a case where the engine output is controlled to become 35 kV as the medium output, is measured in advance, by a method which will be described below later. As described above, the sub-throttle valve 16 is mounted to the sub-throttle shaft 18 driven by the sub-throttle motor 19. For this reason, in some cases, the fully closed position of the sub-throttle valve 16 may be non-uniform and the fully open position of the sub-throttle valve 16 may be non-uniform, depending on the mounting accuracy of the sub-throttle valve 16 with respect to the sub-throttle shaft 18, the rotational speed of the sub-throttle shaft 18, etc.

For example, in the control for opening or closing the sub-throttle valve 16, the sub-throttle valve opening degree is set as a ratio with respect to the fully open position in a case where the fully closed position of the sub-throttle valve 16 is the opening degree 0% and the fully open position of the sub-throttle valve 16 is the opening degree 100%. In a case where the sub-throttle valve opening degree is set based on the fully open position as a reference position, the sub-throttle valve 16 is attached with a high accuracy at the fully open position in manufacturing of the throttle body 13. This can reduce the non-uniformity of the fully open position. However, there is non-uniformity of the fully closed position, and therefore, the sub-throttle valve opening degree is set with a low accuracy. Therefore, it was necessary to learn the fully closed position, for example, when the ignition switch 41 was turned on.

In contrast, in the present embodiment, the medium output opening degree of the sub-throttle valve 16, corresponding to the intake air amount A, is the reference position, and the medium output opening degree is stored in the memory section 35 as a ratio (percentage) in a case where the fully closed position of the sub-throttle valve 16 is 0% and the fully open position of the sub-throttle valve 16 is 100%. Alternatively, the medium output opening degree may be stored in the memory section 35, as the corresponding voltage value O, instead of the ratio (percentage). In a case where the medium output opening degree of the sub-throttle valve 16, corresponding to the engine output limited to 35 kW, is the reference position, the fully closed position of the sub-throttle valve 16 may deviate from the fully closed position in the map stored in the memory section 35, and the fully open position of the sub-throttle valve 16 may deviate from the fully open position in the map stored in the memory section 35. For this reason, the opening degree learning section 36 learns the fully closed position of the sub-throttle valve 16 and the fully open position of the sub-throttle valve 16 which are detected by the sub-throttle valve opening degree sensor 44. For example, the opening degree learning section 36 learns as the learning values a value α which is a ratio of a voltage value indicating the detected fully closed position with respect to a voltage value indicating the fully closed position in the map stored in the memory section 35, and a value β which is a ratio of a voltage value indicating the detected fully open position with respect to a voltage value indicating the fully open position in the map stored in the memory section 35.

In this way, the opening degree learning section 36 learns the fully closed position of the sub-throttle valve 16 which may be non-uniform and the fully open position of the sub-throttle valve 16 which may be non-uniform. In this configuration, when the engine output does not meet the output limiting condition, namely, the engine output is not limited to 35 kW, a learning result obtained by the opening degree learning section 36 can be reflected in setting of the sub-throttle valve opening degree. This allows the sub-throttle valve opening degree to precisely conform to the target opening degree.

Figure 5:
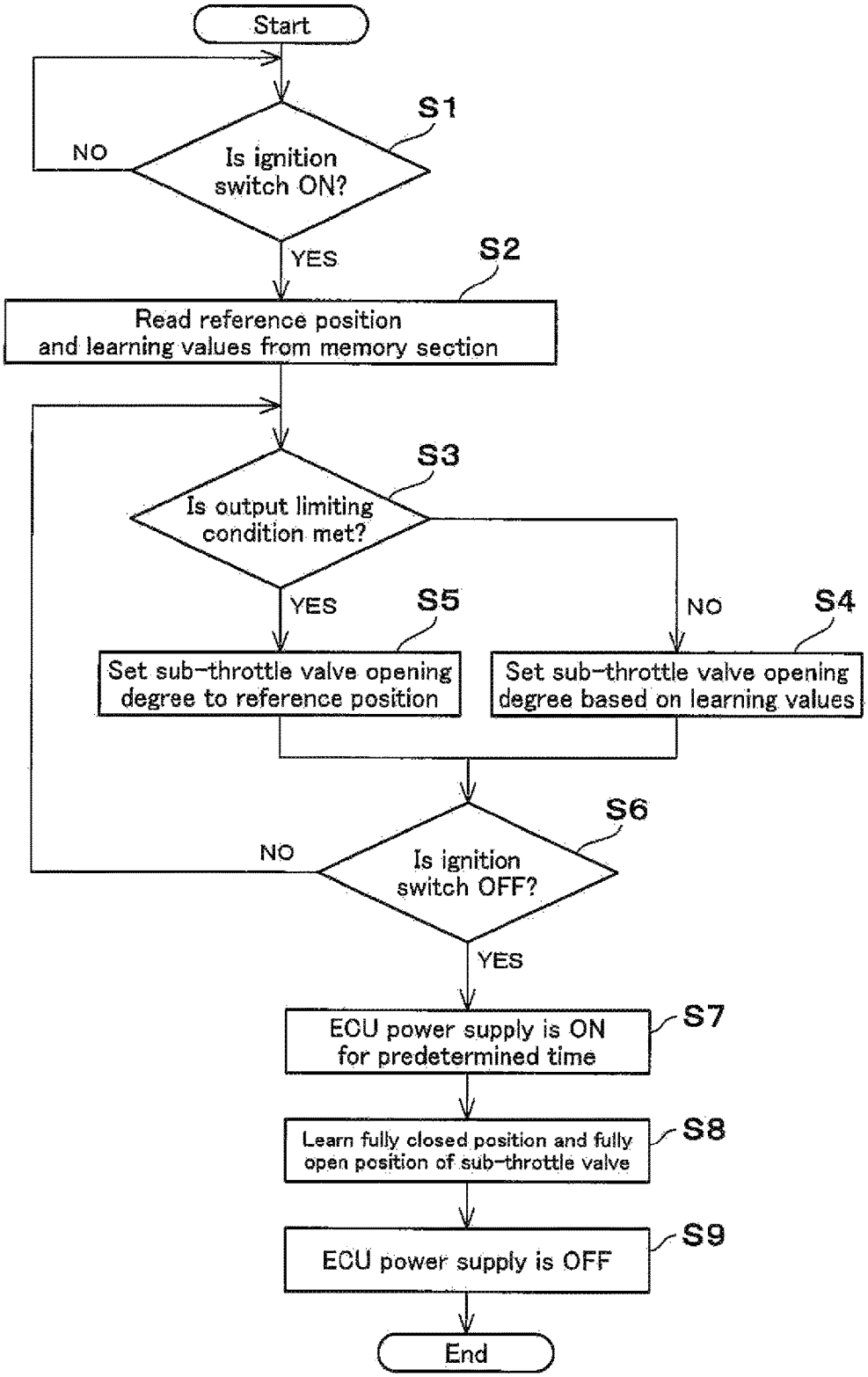
FIG. 5 is a flowchart showing a control for opening or closing the sub-throttle valve of FIG. 2.

FIG. 5 is a flowchart showing the control for opening or closing the sub-throttle valve 16 of FIG. 2. Hereinafter, with reference to the flowchart of FIG. 5, the control for opening or closing the sub-throttle valve 16 which is performed by the ECU 30 will be described. Referring now to FIG. 5, initially, the engine start/stop detecting section 31 determines whether or not the ignition switch 41 has been turned on. When the engine start/stop detecting section 31 determines that the ignition switch 41 has been turned on, an ECU power supply (not shown) for supplying the electric power to the ECU 30 is turned on. Then, the opening degree setting section 33 reads the reference position of the sub-throttle valve 16 and the learning values (the fully closed position and the fully open position) from the memory section 35 (step S2).

Then, the output limiting condition determiner section 32 determines whether or not the engine output meets the output limiting condition (step S3). When the output limiting condition determiner section 32 determines that the engine output does not meet the output limiting condition in step S3, the opening degree setting section 33 reads the target opening degree of the sub-throttle valve 16 from the map stored in the memory section 35, and sets the sub-throttle valve opening degree based on the learning values read from the memory section 35 so that the sub-throttle valve opening degree can precisely conform to the target opening (step S4).

Now, the target opening degree of the sub-throttle valve 16 read from the memory section 35 is indicated by Z, the fully closed position of the sub-throttle valve 16 obtained by the opening degree learning section 36 is indicated by α, and the fully open position of the sub-throttle valve 16 obtained by the opening degree learning section 36 is indicated by β. A sub-throttle valve opening degree X set by the opening degree setting section 33 in step S4 is calculated according to a formula (1):

$$X=((\beta-\alpha)\times Z/100)+\alpha \qquad \text{formula (1)}$$

The formula (1) is a formula in a case where the target opening degree (medium output opening degree) of the sub-throttle valve 16 is stored in the memory section 35 as a ratio in a case where the fully closed position of the sub-throttle valve 16 is 0% and the fully open position of the sub-throttle valve 16 is 100%. Alternatively, in a case where the target opening degree of the sub-throttle valve 16 is stored in the memory section 35 as the voltage value detected by the sub-throttle value opening degree sensor 44 rather than the above-described ratio (percentage), the formula (1) may be changed by converting the ratio into the voltage value.

On the other hand, when the output limiting condition determiner section 32 determines that the engine output meets the output limiting condition in step S3, the opening degree setting section 33 reads the reference position of the sub-throttle valve 16 from the memory section 35, and sets the sub-throttle valve opening degree to the reference position (step S5). In this way, the engine output is limited to 35 kW. In the present embodiment, the engine output is controlled in such a manner that the ECU 30 performs the control for opening or closing the sub-throttle valve 16 according to the result of the determination performed by the output limiting condition determiner section 32 (the steps S3 to S5). In this way, driving control for the engine E is performed.

Then, the engine start/stop detecting section 31 determines whether or not the ignition switch 41 has been turned off (step S6). When the engine start/stop detecting section 31 determines that the ignition switch 41 has not been turned off in step S6, the ECU 30 repeats the steps S3 to S5 until the ignition switch 41 is turned off. On the other hand, when the engine start/stop detecting section 31 determines that the ignition switch 41 has been turned off in step S6, namely, the engine start/stop detecting section 31 detects the termination request command of the engine E, the ECU 30 turns on an ECU power supply for a predetermined time (step S7).

While the ECU power supply is ON for the predetermined time, the opening degree learning section 36 performs a learning operation for learning the fully closed position of the sub-throttle valve 16 and the fully open position of the sub-throttle valve 16, and the learning values obtained by the opening degree learning section 36 are stored in the memory section 35 (step S8). In the present embodiment, every time the ignition switch 41 is turned off, the opening degree learning section 36 performs the learning operation. Thus, after the engine start/stop detecting section 31 determines that the ignition switch 41 has been turned off in step S6, the opening degree learning section 36 performs the learning operation, and the driving control for the engine E (the steps S3 to S5) is not performed. In brief, turning off the ignition switch 41 means that the driving control for the engine E is stopped. Alternatively, the opening degree learning section 36 may be configured to perform the learning operation once in every OFF-operations of the ignition switch 41 of a predetermined number of times, instead of every OFF-operation of the ignition switch 41.

When the predetermined time passes, the learning operation performed by the opening degree learning section 36 is completed. At the completion of the learning operation, the sub-throttle valve 16 is moved to a predetermined opening degree, and then the ECU power supply is turned off (step S9). In this way, the control for opening or closing the sub-throttle valve 16 is terminated. It should be noted that when the rider turns off the ignition switch 41 while the flowchart of FIG. 5 is executed, the control for opening or closing the sub-throttle valve 16 is terminated.

Hereinafter, a manufacturing method of the motorcycle 1 in which the engine output is controlled to become the medium output (in this example, 35 kW) will be described. Initially, a test engine (engine used in a test) to which a test throttle body (throttle body used in the test) is connected is fastened to an engine bench test apparatus. The engine bench test apparatus is used to measure and evaluate a performance of the test engine and is able to obtain the output of the test engine. The test throttle body is provided with a test main throttle valve (main throttle valve used in the test) and a test sub-throttle valve (sub-throttle valve used in the test).

Then, the engine bench test apparatus is activated and measures the opening degree (medium output opening degree) of the test sub-throttle valve in a case where the output of the test engine becomes 35 kW which is the medium output. Specifically, the sub-throttle valve opening degree sensor 44 measures the medium output opening degrees occurring when the output of the test engine is controlled to become 35 kW in cases where the test main throttle valve is opened at various opening degrees. The medium output opening degrees are measured as the voltage values (the voltage values O of FIG. 4) which are the detection values of the sub-throttle valve opening degree sensor 44.

When the step of measuring the medium output opening degree ends, the intake air amount A (see FIG. 4, hereinafter this will be referred to as a medium output intake air amount) of the air to be supplied to the test engine in a case where the test sub-throttle valve is opened at the medium output opening degree is measured. The medium output intake air amount refers to the amount of the air flowing through a passage section provided with an air-intake passage, of the test throttle body.

When the step of measuring the medium output intake air amount ends, the step of assembling an in-vehicle throttle body (the throttle body 13) to be mounted in the motorcycle 1 is performed. In the step of assembling the throttle body 13, there may be dimension errors of the throttle valves 15, 16, and mounting errors of the throttle valves 15, 16 with respect to the throttle shafts 17, 18, respectively, in some cases. Further, after the throttle body 13 is assembled, there may also be non-uniformity of the rotational speeds of the throttle shafts 17, 18, due to, for example, deterioration which progresses over time.

If the errors or non-uniformity occur, while the throttle body 13 is assembled, or after the throttle body 13 is assembled as described above, the intake air amount corresponding to the medium engine output may be varied among products of the throttle body 13. In light of this, a tolerance range is preset for the measured medium output intake air amount taking the errors and non-uniformity into account. Also, a tolerance range is preset for the medium output opening degree to correspond to the tolerance range of the medium output intake air amount. In the present embodiment, the sub-throttle valve 16 is mounted to the sub-throttle shaft 18 so that the medium output opening degrees of the sub-throttle valve 16 falls into the preset tolerance range. Thus, the throttle body 13 is assembled.

When the step of assembling the throttle body 13 ends, the step of storing the medium output opening degree is performed, in which the medium output opening degree is stored in the ECU 30 which performs the control for opening or closing the sub-throttle valve 16. Preferably, the step of storing the medium output opening degree in the ECU 30 is performed in the step of manufacturing the ECU 30 before the ECU 30 is mounted to the vehicle body of the motorcycle 1, to easily perform the step of storing the medium output opening degree. However, the step of storing the medium output opening degree may be performed after the ECU 30 is mounted to the vehicle body. After the step of storing the medium output opening degree is performed, the step of assembling other vehicle members is performed, and thus the step of manufacturing the motorcycle 1 is completed.

The motorcycle 1 which is an example of the straddle-type vehicle, configured and manufactured as described above can obtain the advantages described below.

Prior to manufacturing of the motorcycle 1, the medium output opening degree of the sub-throttle valve 16 at which the output of the test engine surely becomes the medium output (in this example, 35 kW) is measured by use of the engine bench test apparatus, and is pre-stored as the medium output control command in the memory section 35 of the ECU 30. In this setting, when the engine output meets the medium output condition (output limiting condition), the sub-throttle valve 16 is controlled to be opened or closed in accordance with the medium output control command. This makes it possible to more accurately control the engine output so that the engine output becomes the medium output, compared to a configuration in which the opening degree of the sub-throttle valve 16, corresponding to the medium output of the engine E, is controlled based on the ratio with respect to the fully closed position of the sub-throttle valve 16 which may be non-uniform or the fully open position of the sub-throttle valve 16 which may be non-uniform.

engine output is limited to the upper limit value by limiting the throttle valve opening degree by use of a stopper used exclusively for liming the engine output, or by limiting the throttle valve opening degree to a preset upper limit opening degree by use of a controller. In a case where the throttle body includes the main throttle valve and the sub-throttle valve, the opening degree of the main throttle valve was conventionally limited by use of the stopper used exclusively for liming the engine output. However, in this configuration, the number of members is increased. In addition, the stopper may be demounted, and the function of limiting the engine output may be disenabled undesirably.

In the present embodiment, when the engine output meets the output limiting condition, the ECU 30 performs a control so that the sub-throttle valve opening degree becomes the medium output opening degree (reference position) pre-stored in the memory section 35. Therefore, the number of members is not increased, compared to a configuration in which the sub-throttle valve opening degree is limited by use of the stopper used exclusively for liming the engine output. Further, it becomes possible to prevent a situation in which the stopper is demounted, and thereby the function of limiting the engine output is disenabled undesirably.

In a case where the controller limits the throttle valve opening degree to the upper limit opening degree, and the upper limit opening degree is set based on the fully closed position or the fully open position of the throttle valve which is the reference position, the fully closed position may be non-uniform or the fully open position may be non-uniform depending on the mounting accuracy of the throttle valve with respect to the throttle shaft, the rotational speed of the rotary shaft, etc., because the throttle valve is supported on the rotary shaft driven to be rotated by the motor (or the pulley). If the fully closed position or the fully open position which is the reference position is non-uniform, then the accuracy of the upper limit opening degree becomes low. Under this condition, the engine output cannot be limited accurately.

To avoid this, in the present embodiment, the sub-throttle valve opening degree corresponding to the intake air amount in a case where the engine output is limited to the upper limit value is pre-stored as the reference position in the memory section 35 of the ECU 30. In this way, the output limiting of the engine E can be performed with a high accuracy, compared to a configuration in which the upper limit opening degree of the sub-throttle valve opening degree is set based on as the reference position, the fully closed position of the sub-throttle valve 16 which may be non-uniform or the fully open position of the sub-throttle valve 16 which may be non-uniform.

In a case where the fully closed position and the fully open position of the sub-throttle valve 16 are learned after the engine E is started, the engine speed is significantly changed while the learning operation is performed, if the sub-throttle valve 16 is driven to be moved to the fully closed position for the purpose of the learning. This may make the rider feel awkward. However, in the present embodiment, when the ignition switch 41 has been turned off, namely, the termination request command regarding the driving of the engine E has been detected, the opening degree learning section 36 performs the learning operation for learning the fully closed position and the fully open position. Thus, the engine speed is not changed while the opening degree learning section 36 is performing the learning operation, which can prevent the rider from feeling awkward.

Since the opening degree learning section 36 performs the learning operation when the ignition switch 41 has been turned off, the rider need not wait for the completion of the learning operation, compared to a configuration in which the opening degree learning section 36 performs the learning operation after the ignition switch 41 has been turned on.

The opening degree learning section 36 performs the learning operation every time the ignition switch 41 is turned off. Therefore, even when the throttle body 13 is replaced in maintenance or the like, the sub-throttle valve opening degree can be set based on as the reference position the fully closed position and the fully open position which have been obtained most recently by the opening degree learning section 36.

As described above, the ECU 30 includes the control command of the sub-throttle valve 16 based on the learning values and the control command of the sub-throttle valve 16 based on the medium output control command. Therefore, it is not necessary to manufacture the throttle body to prevent occurrence of non-uniformity of the engine output in the case where the engine output does not meet the medium output condition. In addition, when the engine output meets the medium output condition, the engine output can be controlled with a high accuracy to fall into the medium output range. As a result, it becomes possible to prevent occurrence of the non-uniformity of the sub-throttle valve opening degree corresponding to the medium output range, among the products of the throttle body 13, without increasing manufacturing cost.

Since the ECU 30 is connectable to the external input device via the connection terminal 37, the limiting determination program stored in the output limiting condition determiner section 32 of the ECU 30 can be externally disenabled via the connection terminal 37 by use of the external input device. Therefore, even when the output limiting of the engine E is unnecessary, the ECU 30 need not be replaced. As a result, the number of members is not increased, and a new assembling operation is not necessary.

The learning values (the fully closed position and the fully open position of the sub-throttle valve 16) obtained by the opening degree learning section 36 are stored in the memory section 35. Therefore, after the output limiting of the engine E is disenabled, the sub-throttle valve opening degree can be set based on as the reference value the learned fully closed position or the learned fully open position. Therefore, the operation can be performed easily.

In a case where the motorcycle 1 which controls the engine output so that the engine output falls into the preset medium output range is manufactured, the sub-throttle valve opening degree corresponding to the medium output range is measured, then the intake air amount A of the air to be supplied to the engine E when the sub-throttle valve 16 is opened at the measured sub-throttle valve opening degree is measured, and then the throttle body 13 is assembled in such a manner that the opening degree of the sub-throttle valve 16 corresponding to the intake air amount A falls into a tolerance range. Thus, in a case where the engine output is controlled to fall into the medium output range after the motorcycle 1 is manufactured, the sub-throttle valve 16 can be opened at the opening degree measured in advance in accordance with the medium output control command provided by the ECU 30. As a result, the engine output can be controlled with a high accuracy.

The present invention is not limited to the above-described embodiment. The above-described configuration may be changed, added to or deleted from, within a scope of the spirit of the preset invention. Although in the above-described embodiment, the engine output is limited to the predetermined upper limit value depending on the classification of the license acquired by the rider, this configuration is merely exemplary. For example, in a case where an abnormality occurs in the engine E or the like while the motorcycle 1 is traveling, the engine output may be controlled to become the medium output included in a range between the minimum output and the maximum output. More specifically, in a case where an abnormality occurs in a detector (e.g., a speed sensor, an engine speed sensor, a gear position sensor, etc.) which detects the traveling state of the motorcycle 1, and the ECU 30 becomes incapable of detecting a signal output from the detector having the abnormality, the engine output may be controlled to become the medium output, and thus the motorcycle 1 travels in a saving mode. In other words, the motorcycle 1 may shift to a limp home mode driving. Specifically, the medium output control command by which the engine output is controlled to become the medium output according to the requirements specification may be pre-stored in the memory section 35 of the ECU 30. Further, the engine output may be controlled to fall into a predetermined output range.

Although in the above-described embodiment, the engine output is limited to the predetermined upper limit value depending on the classification of the license acquired by the rider, and thereby the engine output is limited every time the output limiting condition determiner section 32 determines that the engine output meets the output limiting condition, irrespective of a driving time period for which the rider has driven the motorcycle 1, this configuration is merely exemplary. In the motorcycle 1 in which the memory section 35 of the ECU 30 contains therein the medium output control command, the engine output may be limited to the upper limit value depending on the driving time period for which the rider has driven the motorcycle 1. In this case, for example, at an initial stage of the driving time period, the engine output is not limited to the upper limit value, while after a passage of a specified time period, the engine output may be limited to the upper limit value. Although in the above-described embodiment, the opening degree learning section 36 learns both of the fully closed position and the fully open position of the sub-throttle valve 16, this configuration is merely exemplary. The opening degree learning section 36 may learn one of the fully closed position and the fully open position. Although in the above-described embodiment, the opening degree learning section 36 performs the learning operation when the ignition switch 41 has been turned off and thereby the ECU 30 determines that the driving control for the engine E has been stopped, this configuration is merely exemplary. For example, a fuel pressure sensor for detecting a pressure in a fuel supply pipe for supplying the fuel to the injector 24 may be used, and the ECU 30 may determine that the driving control for the engine E has been stopped when it determines that the fuel injection amount calculated based on a difference in the pressure detected before the fuel injection is started and the pressure after the fuel injection is started is less than a predetermined threshold. Further, the opening degree learning section 36 may perform the learning operation while the sub-throttle motor 19 is rotating by inertia after the ignition switch 41 has been turned off. Or, the opening degree learning section 36 may perform the learning operation after the ignition switch 41 has been turned on, namely, the engine E has been started.

Although in the above-described embodiment, the throttle body 13 includes the main throttle valve 15 and the sub-throttle valve 16, this configuration is merely exemplary. The throttle body 13 may include only an electronically controlled throttle valve. Although in the above-described embodiment, the motorcycle 1 has been described as an example of the vehicle, this configuration is merely exemplary. For example, the vehicle may be other vehicles such as a three-wheeled vehicle or a four-wheeled vehicle, or ship such as a personal watercraft (PWC).

The invention claimed is:

1. A vehicle comprising:

an engine;

a throttle body including a passage section formed with an air-intake passage through which air to be supplied to the engine flows, and a throttle valve provided in the air-intake passage; and a throttle valve controller which controls opening or closing of the throttle valve, wherein the throttle valve controller includes:

a memory section which pre-stores a medium output control command in such a manner that the medium output control command continues to be stored in the memory section in a state in which electric power supply to the throttle valve controller is ceased, the medium output control command indicating a medium output opening degree of the throttle valve, corresponding to a preset medium output range included in a range between a minimum output and a maximum output of an engine output, the medium output opening degree corresponding to a predetermined upper limit value of the engine output such that when the engine output meets a predetermined output limiting condition, the engine output is controlled to fall into the medium output range while the vehicle is traveling; and a learning section that performs a learning operation for learning a fully closed position and a fully open position of the throttle valve, wherein the controller controls opening or closing of the throttle valve in accordance with a control command based on a learning value obtained by the learning section, when the engine output does not meet the output limiting condition; and wherein the controller controls opening or closing of the throttle valve in accordance with the medium output control command read from the memory section, when the engine output meets the output limiting condition.

2. The vehicle according to claim 1, further comprising:

a termination request detector which detects a termination request command regarding driving of the engine, wherein the learning section performs the learning operation, when the termination request detector has detected the termination request command.

3. The vehicle according to claim 1, wherein the learning section performs the learning operation when driving control for the engine is stopped.

4. The vehicle according to claim 1, wherein the memory section stores therein the learning value obtained by the learning section before the electric power supply to the throttle valve controller is ceased, and wherein the throttle valve controller reads the learning value from the memory section after the electric power supply to the throttle valve controller is started, and controls opening or closing of the throttle valve based on the learning value.

5. A method of manufacturing a vehicle, the method comprising:

measuring a medium output opening degree of a test throttle valve that precedes a throttle body to be mounted in the vehicle, corresponding to a preset medium output range for an output limitation included in a range between a minimum output and a maximum output of a test engine output, by use of an engine bench test apparatus which obtains the test engine output;

measuring a medium output intake air amount in a case where the test throttle valve is opened at the medium output opening degree;

assembling the throttle body to be mounted in the vehicle in such manner that the medium output opening degree of a throttle valve to be mounted in the vehicle falls into a preset tolerance range, the medium output intake air amount being obtained at the medium output opening degree; and pre-storing a medium output control command in a throttle valve controller which controls opening or closing of the throttle valve to be mounted in the vehicle, the medium output control command indicating the medium output opening degree of the throttle valve to be mounted in the vehicle, corresponding to the medium output intake air amount.

* * * * *